US006332652B1

(12) United States Patent
Nakakuro

(10) Patent No.: US 6,332,652 B1
(45) Date of Patent: Dec. 25, 2001

(54) TUNNEL EXCAVATOR WITH VARIABLE PRESSURE WATER JETS

(75) Inventor: Kenichi Nakakuro, Toyama-ken (JP)

(73) Assignee: Nakakuro Construction Co., Ltd., Toyama-Ken (JP)

( * ) Notice: Subject to any disclaimer, the term of this patent is extended or adjusted under 35 U.S.C. 154(b) by 0 days.

(21) Appl. No.: 09/573,852

(22) Filed: May 19, 2000

(30) Foreign Application Priority Data

Feb. 2, 1999 (JP) ..... 11-25459
Aug. 24, 1999 (JP) ..... 11-237448

(51) Int. Cl.[7] ..... E21D 9/11; E21C 25/60
(52) U.S. Cl. ..... 299/55; 299/17; 299/81.2; 299/1.8
(58) Field of Search ..... 299/17, 55, 56, 299/58, 81.1, 81.2, 81.3, 1.8; 405/138, 141

(56) References Cited

U.S. PATENT DOCUMENTS 3,339,980 9/1967 Winberg .
4,692,062 9/1987 Akesaka .
4,921,306 * 5/1990 Tomlin ..... 299/17
5,114,213 * 5/1992 Kornecki, et al. ..... 299/81.2

FOREIGN PATENT DOCUMENTS 8100264 8/1982 (NL) .

OTHER PUBLICATIONS

Stack, Barbara "Handbook of Mining and Tunnelling Machinery" 1982, John Wiley and Sons, pp. 312–319.*
Patent Abstracts of Japan, vol. 1998, No. 10, Aug. 31, 1998 & JP 10 121888 A (Nakaguro Kensetsu KK,) May 12, 1998.

* cited by examiner

*Primary Examiner*—David Bagnell
*Assistant Examiner*—John Kreck
(74) *Attorney, Agent, or Firm*—Wenderoth, Lind & Ponack, L.L.P.

(57) ABSTRACT

An excavator including a center shaft rotatably provided in a shield body in concentric relation to an outer cone. An inner cone for crushing excavated materials in cooperation with the outer cone is eccentrically provided on the center shaft. A cutter head provided in front of the inner cone is mounted on the center shaft. An internally-toothed gear is secured to the inner cone in concentric relation to the center shaft. A plurality of externally-toothed gears rotated by driving motors whose rotational speed and torque are variably controllable are internally meshed with the internally-toothed gear. Rotation of the externally-toothed gears causes the center shaft to rotate through the inner cone. A plurality of water jet spray nozzles are provided on the cutter head. The spray pressure is switched between high pressure and low pressure.

20 Claims, 12 Drawing Sheets

E–E

A–A

B–B

MOTOR OUTPUT-TORQUE CHARACTERISTICS

TUNNEL EXCAVATOR WITH VARIABLE PRESSURE WATER JETS

BACKGROUND OF THE INVENTION

The present invention relates to an improvement in an excavator of the type wherein a center shaft is rotatably provided in a shield body in concentric relation to an outer cone, and an inner cone for crushing excavated materials in cooperation with the outer cone is eccentrically provided on the center shaft, and further a cutter head positioned in front of the inner cone is mounted on the center shaft. More particularly, the present invention relates to an excavator wherein a cutter head (crusher head) is provided with jet water spray nozzles, and jet water spray modes are switched between high-pressure spray and low-pressure spray according to the soil and obstruction conditions in an area to be excavated, and wherein jet water is mixed with an abrasive or an additive according to circumstances, and the rotational speed and torque of a cutter driving motor are also varied during excavation according to circumstances, thereby markedly improving shield and semi-shield machines in excavation function.

There have heretofore been known excavators, e.g. shield machines, in which a center shaft is rotatably provided in a shield body in concentric relation to an outer cone, and an inner cone for crushing excavated materials in cooperation with the outer cone is eccentrically provided on the center shaft, and further a cutter head having a plurality of roller cutters (roller bits) is mounted on a forward end portion of the center shaft in front of the inner cone. In this type of excavators, a motor with reduction gears is connected directly to the center shaft to rotate the center shaft, thereby rotating the cutter head. Alternatively, a motor with reduction gears and the center shaft are provided with respective externally-toothed gears, which are meshed with each other, to rotate the center shaft, thereby rotating the cutter head. The center shaft has a crankshaft shape in order to mount the inner cone eccentrically with respect to the outer cone. By the cooperation of the cutter head, the outer cone and the inner cone, materials to be excavated, i.e. earth and sand, gravel, and cobble stones, are continuously excavated.

Incidentally, soil conditions vary widely with working ranges, sites and depths. Even an excavation cross-section in one working area often contains an ordinary soil layer, a sandy soil layer, a gravel layer, a concrete layer, etc. in the form of an alternate layer structure. There may be a rock mass layer in addition to the above-mentioned layers. It is difficult to excavate ground having such soil conditions by using only one type of conventional excavator for reasons stated below.

(1) The optimum rotational speed and optimum torque of the cutter are different for different soil conditions. The cutter configuration also needs to be changed in conformity to each particular set of soil conditions.

(2) Regarding a system for conveying excavated materials, it is necessary to select a transport system according to soil conditions, e.g. a hydraulic transport system, a transport system using a screw conveyor, a transport system using a muck car, etc.

In the case of employing a hydraulic transport system, in particular, when gravel is transported as a crushed excavated material, the size of transportable gravel is determined by the diameter of a slurry discharge pipe used. Therefore, it is necessary to use an excavator capable of crushing gravel into pieces of a transportable size.

(3) When there are obstructions such as boulder gravel or a concrete layer, it is necessary to use a high-power excavator capable of previously tearing the obstructions and of crushing the boulder gravel into smaller pieces that can be taken into the excavator.

The relationship between the rotational speed and torque of the cutter for optimally excavating ground according to soil conditions is roughly as follows:

Ordinary soil, sandy soil medium speed, medium torque
Sand gravel, gravel ground low speed, high torque
Rock mass high speed, low torque Because characteristics required for an excavator differ according to soil conditions and according to whether or not there are obstructions in layers to be excavated, as stated above, it has heretofore been all a single conventional excavator can do to excavate ground including only ordinary soil, sandy soil and a gravel layer, and necessary in order to excavate ground containing other large obstructions to use two or more different types of excavators.

SUMMARY OF THE INVENTION

In view of the above-described circumstances and in compliance with new demands of recent civil engineering works, an object of the present invention is to provide a multi-function excavator capable of excavation in conformity to not only various soil conditions but also obstructive conditions, e.g. the presence of a concrete wall or layer. More specifically, the object of the present invention is to provide an excavator designed so that the jet water spray pressure can be switched between high pressure and low pressure according to the soil and obstruction conditions in a working range, and jet water is mixed with an abrasive or an additive according to circumstances, and further high-power driving motors can be readily provided in a narrow shield body to change the torque and rotational speed of the cutter in a multistage manner.

To attain the above-described object, the present invention provides an excavator including a center shaft rotatably provided in a shield body in concentric relation to an outer cone. An inner cone is eccentrically provided on the center shaft to crush excavated materials in cooperation with the outer cone. A cutter head is provided in front of the inner cone. An internally-toothed gear is secured to the inner cone in concentric relation to the center shaft. An externally-toothed gear is internally meshed with the internally-toothed gear. The externally-toothed gear is driven to rotate by a driving motor. The rotation of the externally-toothed gear causes the center shaft to rotate through the inner cone. A plurality of water jet spray nozzles are provided on the cutter head. A multihole compressed water pipe is provided in the center shaft so as to communicate with the water jet spray nozzles. The compressed water pipe selectively supplies low-pressure water and high-pressure water such that, during excavation of ground free from obstructions, the low-pressure water is supplied, whereas, during excavation of ground containing obstructions, the high-pressure water is supplied.

In the above excavator, water supplied to the compressed water pipe may be mixed with an abrasive for cutting obstructions or an additive for tearing obstructions according to soil conditions. As the abrasive, siliceous sand, glass fiber powder, etc. may be used appropriately. As the additive, conventional polymers may be used appropriately.

The driving motor may be an electric motor or a hydraulic motor.

Preferably, the rotational speed and torque of the driving motor are controlled according to soil conditions.

The driving motor may be a motor with reduction gears and varied in speed by inverter control.

The center shaft may be provided with a composite swivel joint for water jets.

Preferably, the composite swivel joint has composite piping formed in the center shaft and connected to the water jet spray nozzles to function as a multi-passage swivel joint.

Preferably, the water jet spray nozzles are provided at the forward end of the composite piping and connected to the composite piping through respective pipes, so that a water jet spray nozzle at an appropriate position can be selected to spray a water jet.

The water jet spray nozzles may be installed on the cutter head at any desired angles, so that the spray directions of water jets can be set freely.

Preferably, a slit plate is secured to the rear end of the shaft of the composite swivel joint. The slit plate has slits at positions corresponding to the positions of the spray nozzles installed on the cutter head, thereby detecting the positions of the spray nozzles.

Preferably, a lamp box is provided in front of the slit plate, and a front target is provided behind the slit plate, thereby detecting the direction of excavation.

Preferably, a pinion is provided on the output shaft of the motor with reduction gears. The pinion is internally meshed with an internally-toothed gear that is rotatable relative to a bulkhead, so that the rotation of the motor is secondarily reduced in speed. In addition, a driving shaft is concentrically secured to the internally-toothed gear. The above-described externally-toothed gear is mounted on the driving shaft.

Preferably, an earth pressure detector is provided at the rear end of the center shaft to detect axial force acting on the cutter head during propulsion as an earth pressure.

Preferably, the shield body is provided with a gripper mechanism for preventing rolling of the shield body. The gripper body includes a hydraulic cylinder mounted on the inner wall of the shield body. The gripper body further includes a revolving roller capable of advancing toward the tunnel inner wall and retracting therefrom. The pressure with which the revolving roller is pressed against the tunnel inner wall is adjustable with the hydraulic cylinder.

The above and other objects, features and advantages of the present invention will become more apparent from the following description of the preferred embodiment thereof, taken in conjunction with the accompanying drawings.

DETAILED DESCRIPTION OF THE INVENTION

The present invention will be described below in detail with reference to the accompanying drawings.

Figure 1:
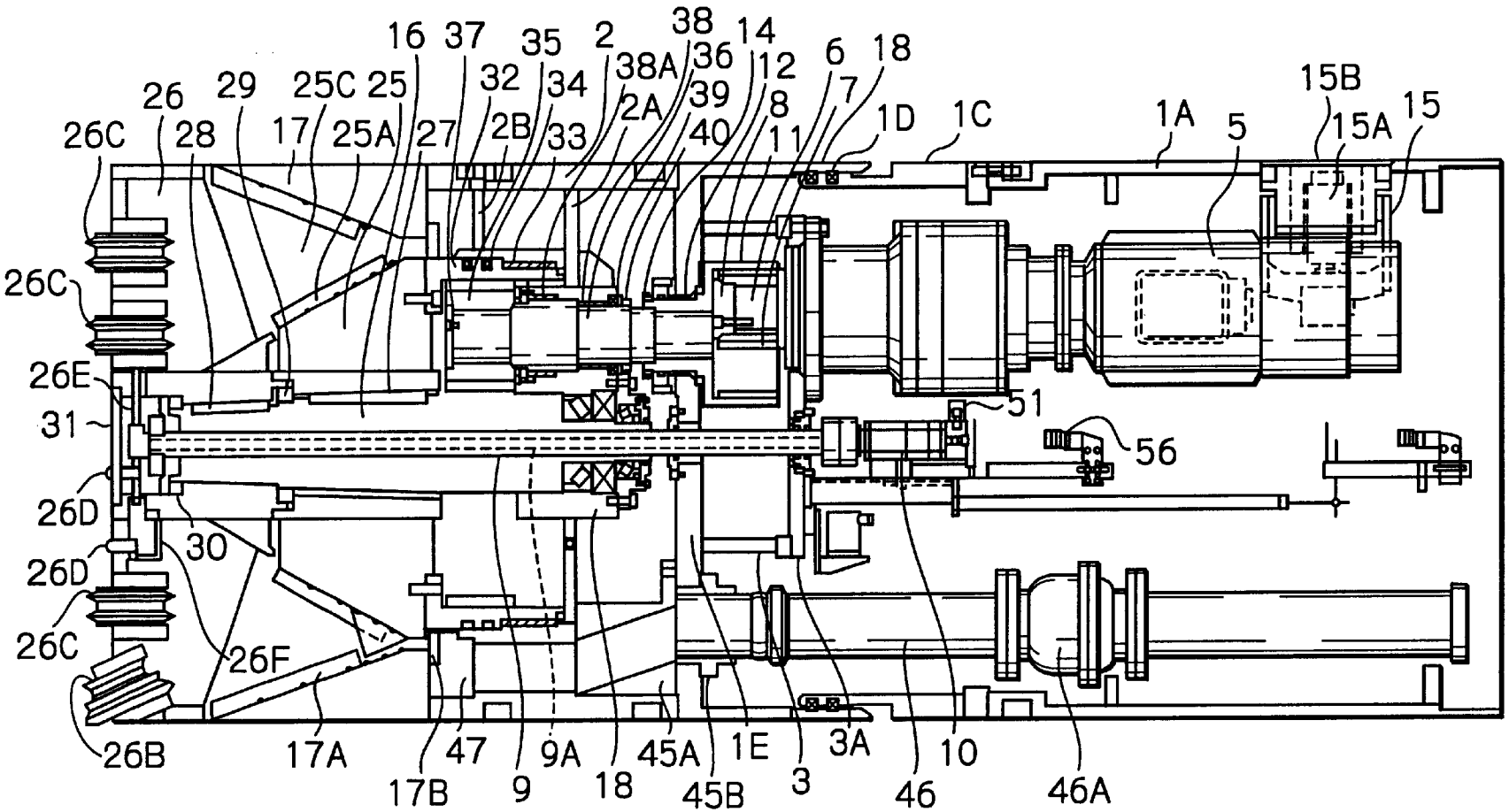
FIG. 1 is a vertical sectional view of the excavator according to the present invention.
Figure 2:
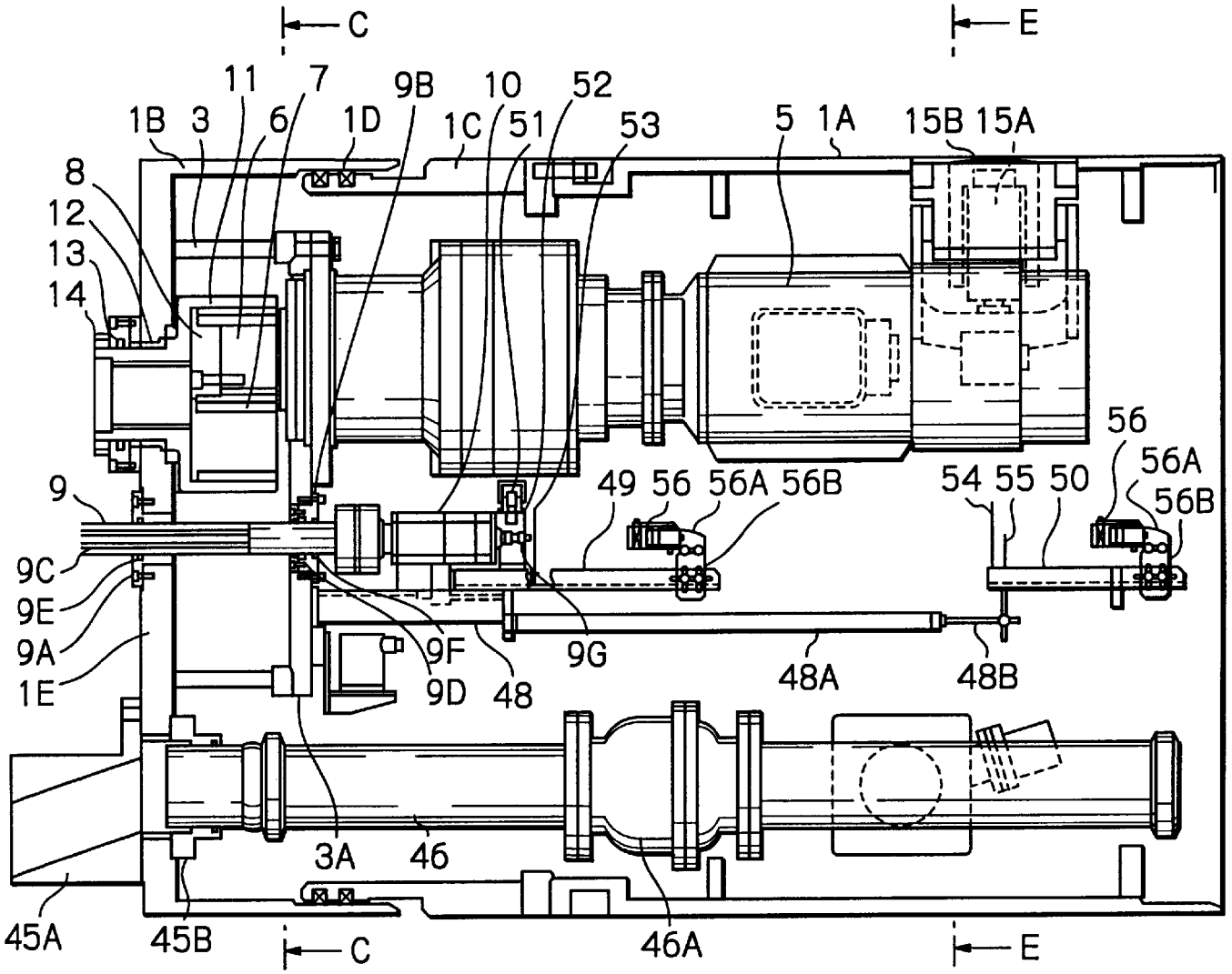
FIG. 2 is an enlarged sectional view of a tail shield member shown in FIG. 1.
Figure 3:
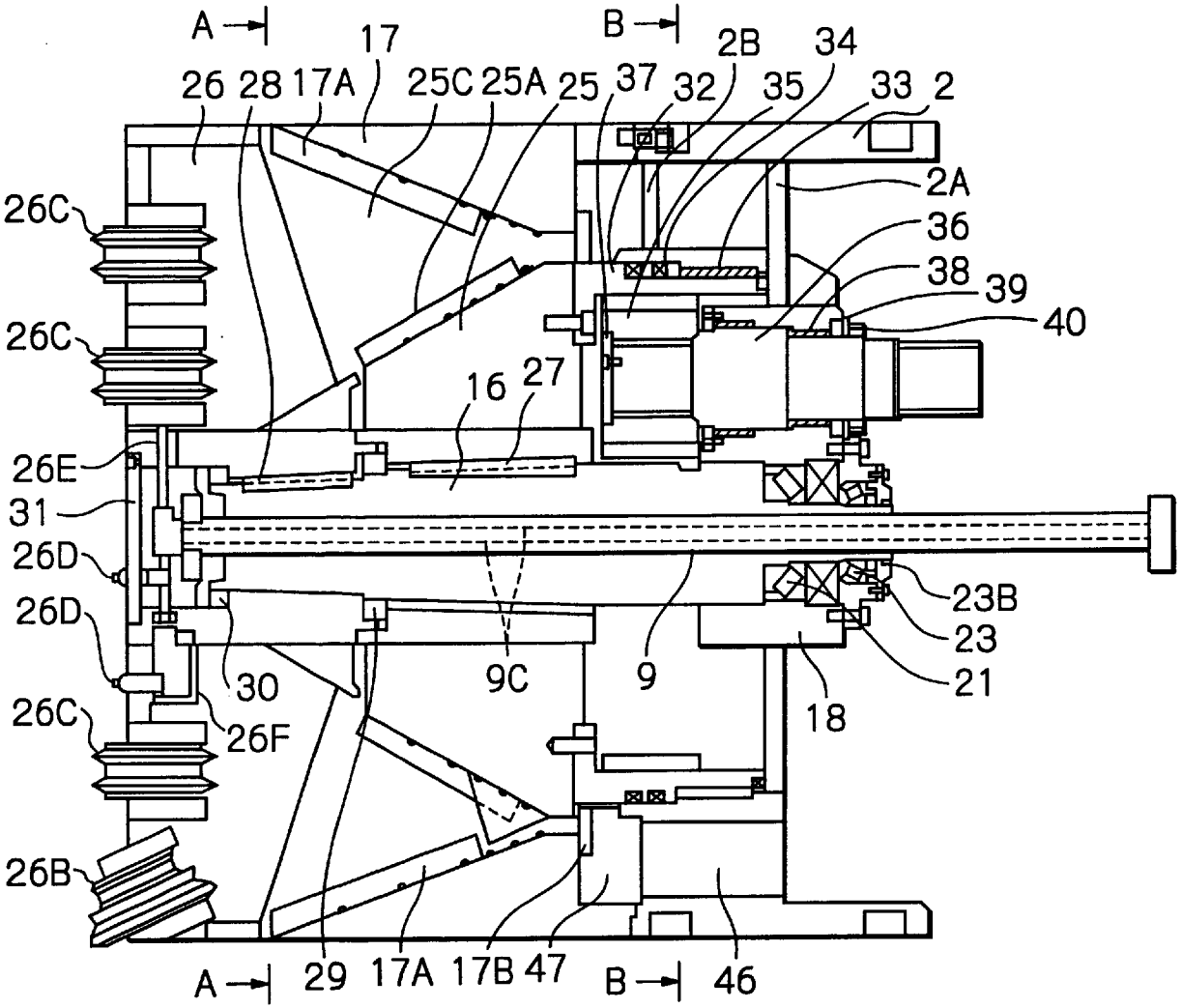
FIG. 3 is an enlarged sectional view of a front shield member shown in FIG. 1.

Referring to FIGS. 1 to 3, a cylindrical tail shield member 1 and a cylindrical front shield member 2 constitute in combination a shield body. The tail shield member 1 consists essentially of a tail shield rear tube 1A, a tail shield front tube 1B, and a tail shield middle tube 1C. A sealing member 1D is provided at the joint between the tail shield middle tube 1C and the tail shield front tube 1B. The tail shield middle tube 1C and the tail shield front tube 1B are connected through jack mechanisms 4 for direction correction.

A bulkhead 1E is provided at the front end of the tail shield front tube 1B. A gear case 3 is secured to the bulkhead 1E. A mounting plate 3A is secured to the gear case 3. A motor 5 with reduction gears is secured to the mounting plate 3A. Reference numeral 6 denotes an output shaft of the motor 5.

Figure 5:
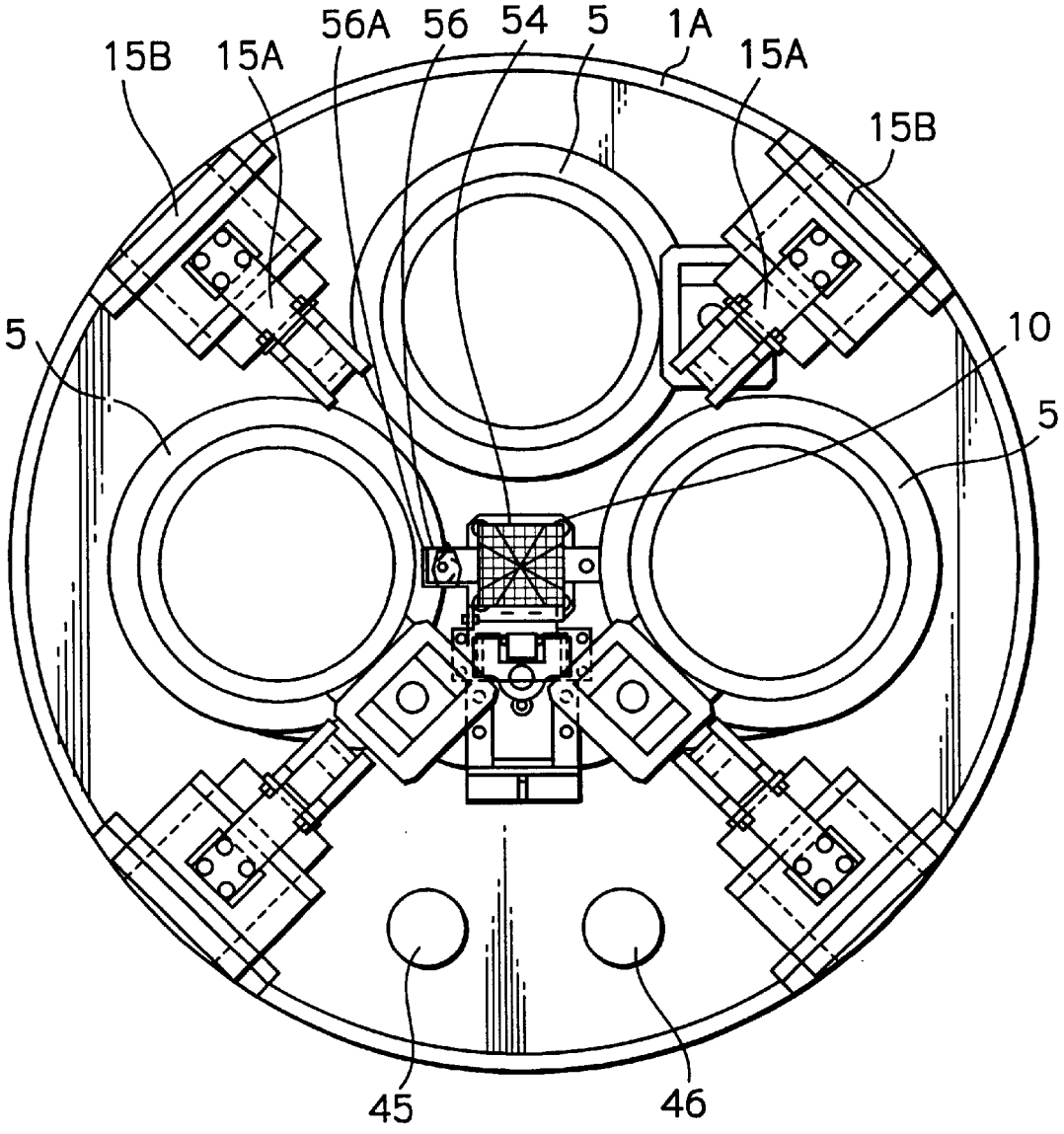
FIG. 5 is a sectional view taken along the line E—E in FIG. 2.
Figure 6:
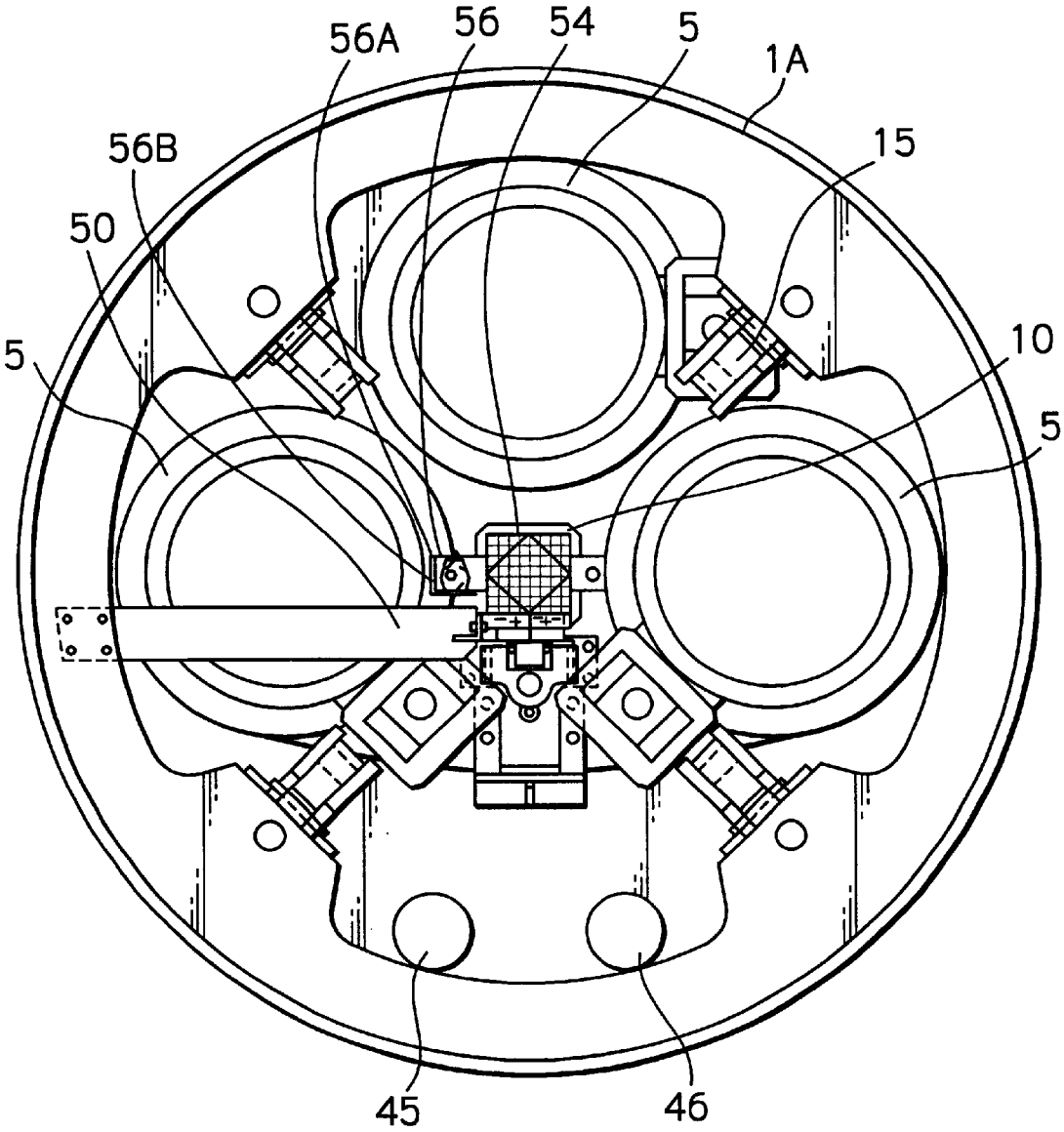
FIG. 6 is a diagram showing the inside of a tail shield rear tube as viewed from the rear thereof.

There are provided a plurality of motors 5 with reduction gears. The motors 5 are spaced circumferentially along the inner periphery of the tail shield member 1. In this embodiment, the number of motors 5 is three, as shown in FIGS. 5 and 6. An externally-toothed pinion 7 is mounted on the output shaft 6 of each motor 5. Reference numeral 8 denotes a gear stopper member.

In the tail shield member 1, composite piping 9 is provided in concentric relation to the center axis of the tail shield member 1. The composite piping 9 is used to supply compressed water for water jets to a cutter head (described later). A composite swivel joint 10 is provided at the rear of the composite piping 9.

The composite piping 9 is rotatably supported through bearings 9D by a housing 9A installed in the bulkhead 1E and a housing 9B installed in the mounting plate 3A. The housings 9A and 9B are sealed with respective oil seal members 9E and 9F. The composite piping 9 extends through a center shaft 16. The composite swivel joint 10 is bonded to the rear end of the composite piping 9 for convenience of maintenance.

The use of the composite swivel joint 10 makes it possible to realize a plurality of piping systems capable of spraying a plurality of water jets by using a narrow space, that is, a multi-passage piping structure, because the composite piping 9 is accommodated in the center shaft 16 in the form of a shaft provided with a plurality of though-holes 9C for water jets, unlike the conventional swivel joint adapted for a single-passage piping structure. Thus, a water jet can be sprayed from any of spray nozzles 26D provided at the forward end of the composite piping 9 through a pipe 26E. A compressed water pipe that communicates with the spray nozzles 26D for spraying water jets selectively supplies low-pressure water and high-pressure water such that, during excavation of ground free from obstructions, low-pressure water is supplied, whereas during excavation of ground containing obstructions, high-pressure water is supplied. Thus, a water jet can be used without disturbing the face by selecting an appropriate spray nozzle 26D according to the condition of the face. Further, an abrasive or an additive may be mixed with water supplied to the water jet spray nozzles 26D according to the condition of the working range, thereby cutting and tearing obstructions and thus allowing the excavation speed to be increased.

When excavating the ordinary ground free from such obstructions as cobble stones and floodwood, the excavator uses a relatively low water pressure (about 140 kgf/cm$^2$) for jet water with a view to minimizing disturbance of the ground and to preventing the nozzles from being blocked by earth and sand. Upon encountering obstructions, an abrasive or an additive is mixed with water to be sprayed according to need, and the water jet spray mode is switched to high-pressure spray (about 2,500 kgf/cm$^2$), thereby allowing only the obstructions to be surely subjected to primary crushing by cutting and tearing. The additive increases the specific gravity of spray water by several tens of e and thus enhances the impact force of water jets, thereby allowing even more efficient crushing or tearing of obstructions. Thus, excavation can be accomplished without disturbing the ground by appropriately switching the pressure and composition of jet water as stated above. Accordingly, it is possible to complete the intended construction without causing adverse effects such as subsidence of the ground surface. It should be noted that the pressure of high-pressure water can be set at will within the range of from about 1,500 to about 4,000 kgf/cm$^2$ according to the kind of obstructions (cobble stones, floodwood, a concrete layer, etc.). Water jet pump units for high pressure and low pressure are independently installed at the top of a departure shaft. During excavation of the ordinary ground, the above-described low-pressure water is constantly supplied to the excavator by the low-pressure pump through the compressed water pipe. When obstructions appear in the face, the low-pressure pump is switched to the high-pressure pump to supply high-pressure water, which may be mixed with an abrasive and/or an additive according to need, thereby continuously performing excavation while crushing the obstructions. Thus, it is possible to accomplish safe and reliable construction with high efficiency while removing obstructions without disturbing the ground unnecessarily by appropriately using either or both of the pressure and composition of jet water according to circumstances. In addition, low-pressure water that is constantly supplied during excavation of the ordinary ground prevents the spray nozzles from being blocked by earth and sand.

A plurality of spray nozzles 26D can be installed on a cutter head 26 at any desired angles. Therefore, the water jet spray direction can be set freely. For example, water jets may be sprayed in the direction of the center line of the excavator. Alternatively, water jets may be sprayed toward the outer periphery of the excavator.

Detection of the selected positions of the spray nozzles 26D is a process desirable to carry out for alignment of the nozzle position in the plane of the cutter head 26 with the position of gravel encountered during excavation. However, because the spray nozzles 26D are installed on the cutter head 26, the nozzle positions change with the rotation of the cutter head 26. Conventional nozzle position indicating devices are arranged such that the position of a nozzle is indicated by combining a gear with a rotating shaft or by attaching an illuminant to a rotating shaft. However, the conventional devices suffer from problems such as inadequate accuracy of the detected position, complexity of the detecting mechanism itself, and excess cost. In the present invention, a slit plate 52 is secured to the rear end of the shaft of the composite swivel joint 10 by using a screw 9G. The slit plate 52 has slits formed at positions corresponding to the positions of the spray nozzles 26D installed on the cutter head 26. Accordingly, it is possible to confirm the nozzle positions accurately by addition of simple parts.

In the above-described spray nozzle position detecting device, electric lamps 58 are incorporated in a lamp box 51 in front of the slit plate 52. A front target 53 made of a transparent acrylic plate is provided behind the slit plate 52. As the shaft of the composite swivel joint 10 rotates, the slit plate 52 also rotates. Light from the electric lamps 58 in the lamp box 51 passes through the circular slits of the slit plate 52 and is projected on the front target 53 in the form of light spots. The light spots are received with a TV camera 56 and displayed on a TV monitor provided on a control panel outside the excavator, thereby allowing the positions of the spray nozzles 26D to be confirmed.

A pointer mounting rod 48A extends rearward of the TV camera 56 in coaxial relation to the composite swivel joint 10. A rear target 54 is secured to the pointer mounting rod 48A to watch passage of laser light from a laser apparatus fixedly provided at the rear of the excavator and to monitor the attitude of the forward moving part of the excavator and the deviation from the normal line to the face.

Figure 4:
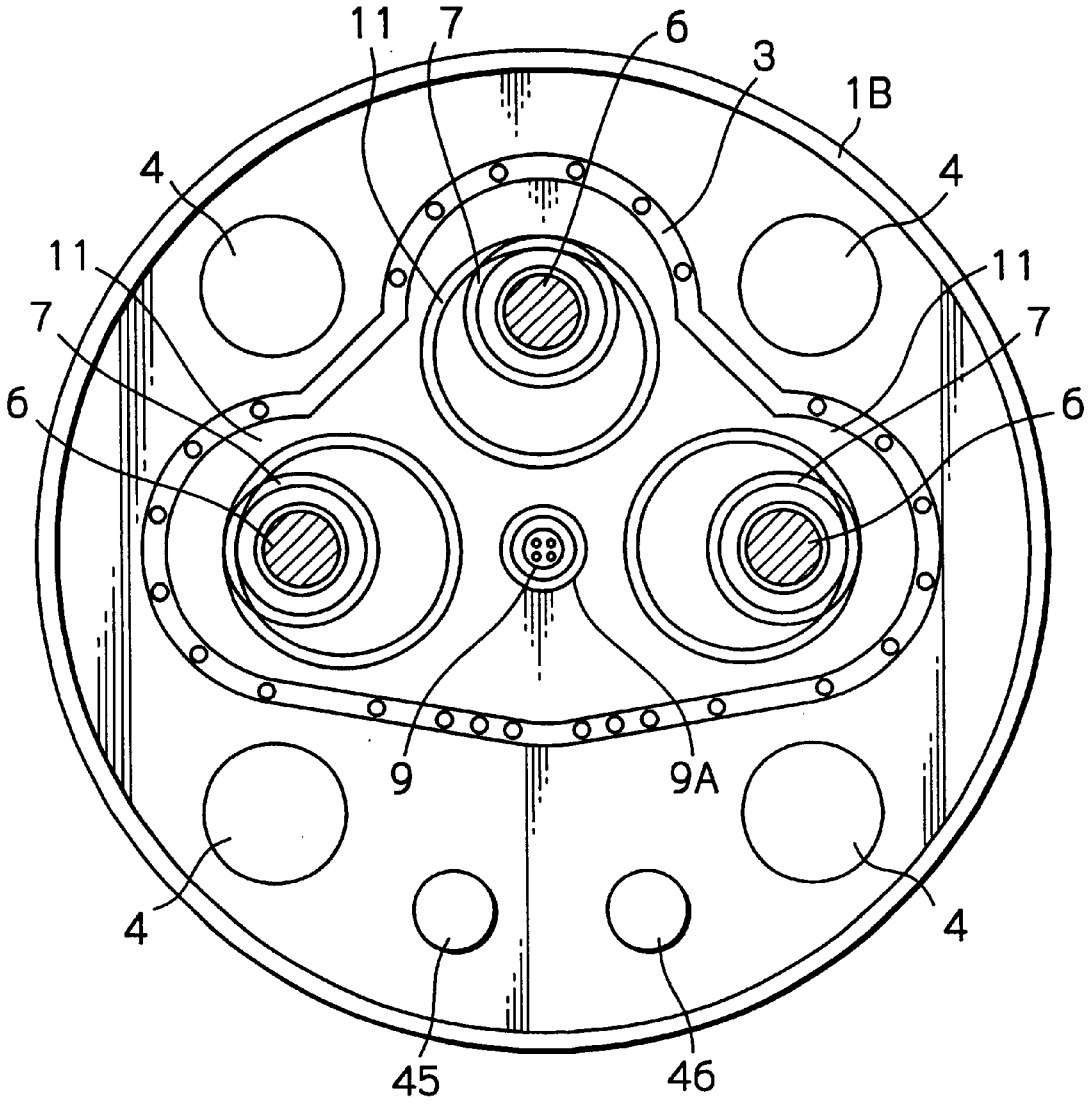
FIG. 4 is a sectional view taken along the line C—C in FIG. 2.

The bulkhead 1E is provided with internally-toothed gears 11 at respective positions that are eccentric with respect to the center axis of the tail shield member 1. The internally-toothed gears 11 are rotatably supported by respective flanged-metal members 12. As shown in FIG. 4, the externally-toothed pinions 7 are internally meshed with the internally-toothed gears 11, respectively. Reference numeral 13 denotes an oil seal member for each internally-toothed gear 11, and reference numeral 14 denotes a nut for mounting a driving shaft (described later).

Gripper mechanisms 15 are provided in the rear of the tail shield rear tube 1A, as shown in FIGS. 1, 2 and 5. Each gripper mechanism 15 consists essentially of a hydraulic cylinder 15A and a revolving roller 15B for a gripper. The hydraulic cylinder 15A is mounted on the inner wall of the tail shield rear tube 1A. The revolving roller 15B is rotatably mounted on the distal end of a piston rod of the hydraulic cylinder 15A.

The revolving roller 15B is adjustable to advance from the tail shield rear tube 1A toward the tunnel inner wall by the hydraulic cylinder 15A. Thus, it is possible to adjust the pressure with which the revolving roller 15B is pressed against the tunnel inner wall and hence possible to prevent rolling.

In the prior art, steel plate blades, beads, etc. are provided on the outer periphery of the tail shield member 1 as a measure to prevent rolling. However, with the conventional device, rolling cannot always be prevented as expected because of an increase in initial thrusting force based on an increase in ground resistance and variations in the gap between the ground and the excavator. In contrast to the conventional device, the gripper mechanisms 15 make it possible to adjust the pressure with which the revolving rollers 15B are pressed against the tunnel inner wall and hence possible to obtain the intended rolling preventing effect.

In the front shield member 2, bulkheads 2A and 2B are provided, as shown in FIGS. 1 and 3, and the center shaft 16 is also provided. The center shaft 16 is concentric with respect to the center axis of the front shield member 2. In addition, an outer cone 17 is provided at the forward end of the front shield member 2. The outer cone 17 is concentric with the center shaft 16. The center shaft 16 is rotatably supported by a bearing tube 18. The bearing tube 18 is secured to the bulkheads 2A and 2B. The inside of the center shaft 16 is hollow. The composite piping 9 extends through the hollow portion of the center shaft 16.

The rear end portion of the center shaft 16 is reduced in diameter, and the reduced-diameter portion is provided with an earth pressure detector 19 through a thrust bearing 21. The earth pressure detector 19 functions as a device for detecting the earth pressure during excavation.

Figure 7:
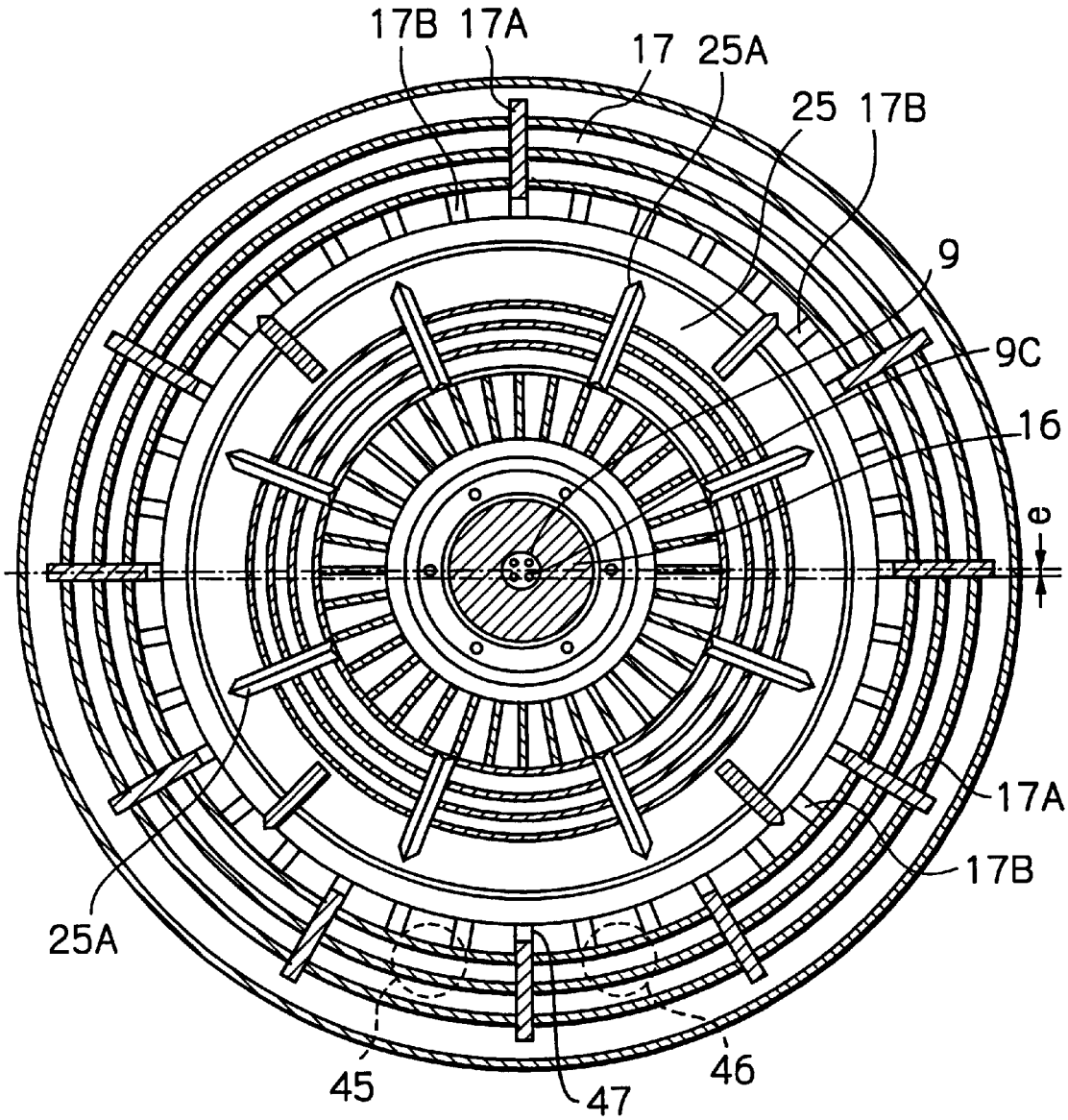
FIG. 7 is a sectional view taken along the line A—A in FIG. 3.

The front end portion of the center shaft 16 is tapered. An inner cone 25 and the cutter head 26 are fitted on the tapered portion of the center shaft 16. As shown in FIG. 7, the inner cone 25 is eccentric with respect to the center shaft 16 as indicated by reference symbol e. The inner cone 25 and the cutter head 26 are fitted to the center shaft 16 through keys 27 and 28 so as to be rotatable together with the center shaft 16 as one unit.

The inner cone 25 and the cutter head 26 are prevented from becoming dislodged from the center shaft 16 by respective nuts 29 and 30. The inner cone 25 is provided at a position corresponding to the outer cone 17. The inner cone 25 is provided with radial crushing pieces 25A. The outer cone 17 is provided with radial shearing pieces 17A.

The inner cone 25 increases in diameter as the distance from the front end thereof increases toward the rear end thereof. The outer cone 17 decreases in diameter as the distance from the front end thereof increases toward the rear end thereof. The space between the outer cone 17 and the inner cone 25 defines a crushing chamber 25C for crushing excavated materials taken thereinto.

Figure 8:
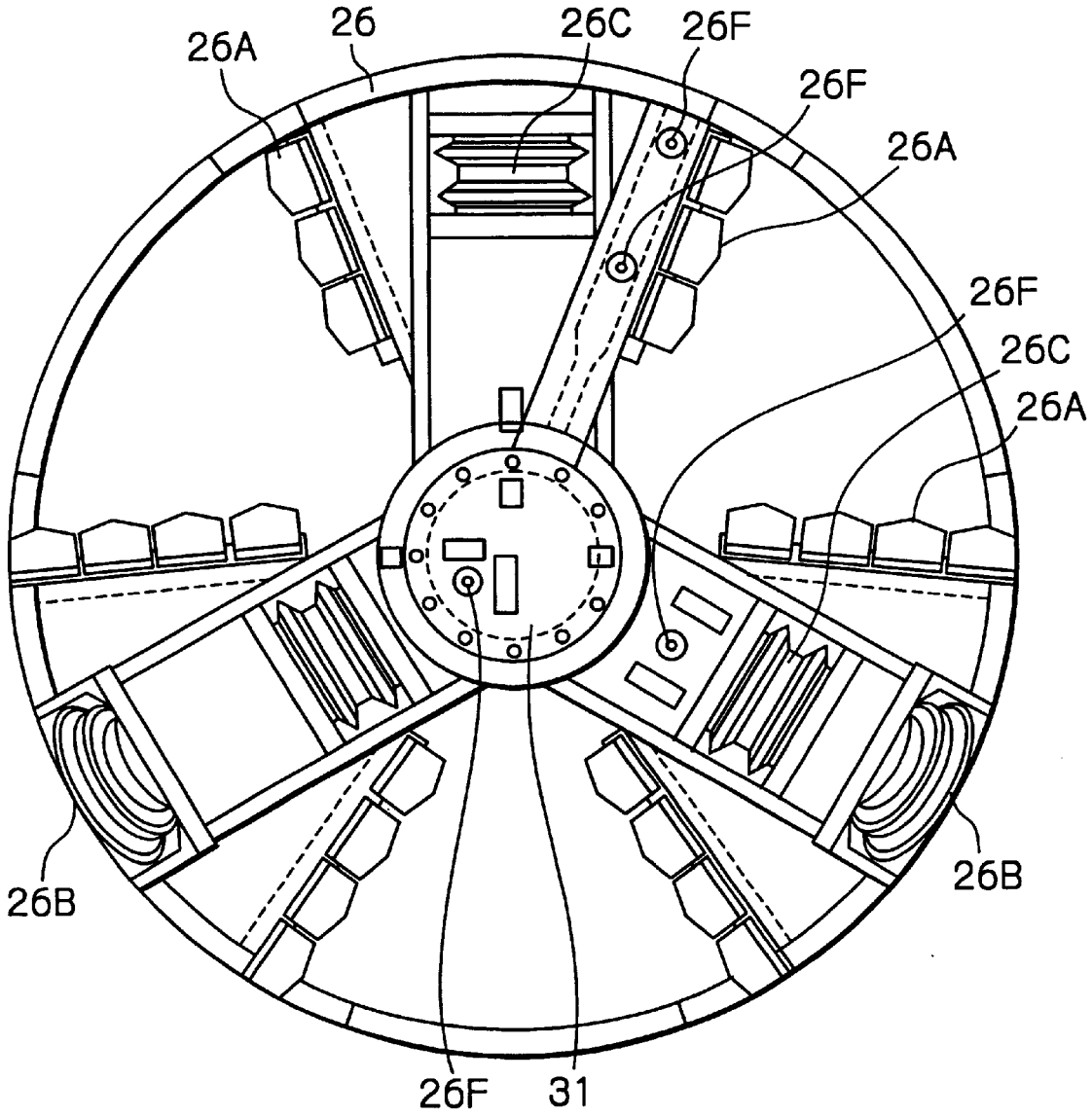
FIG. 8 is a front view of a cutter head shown in FIG. 1.
Figure 9:
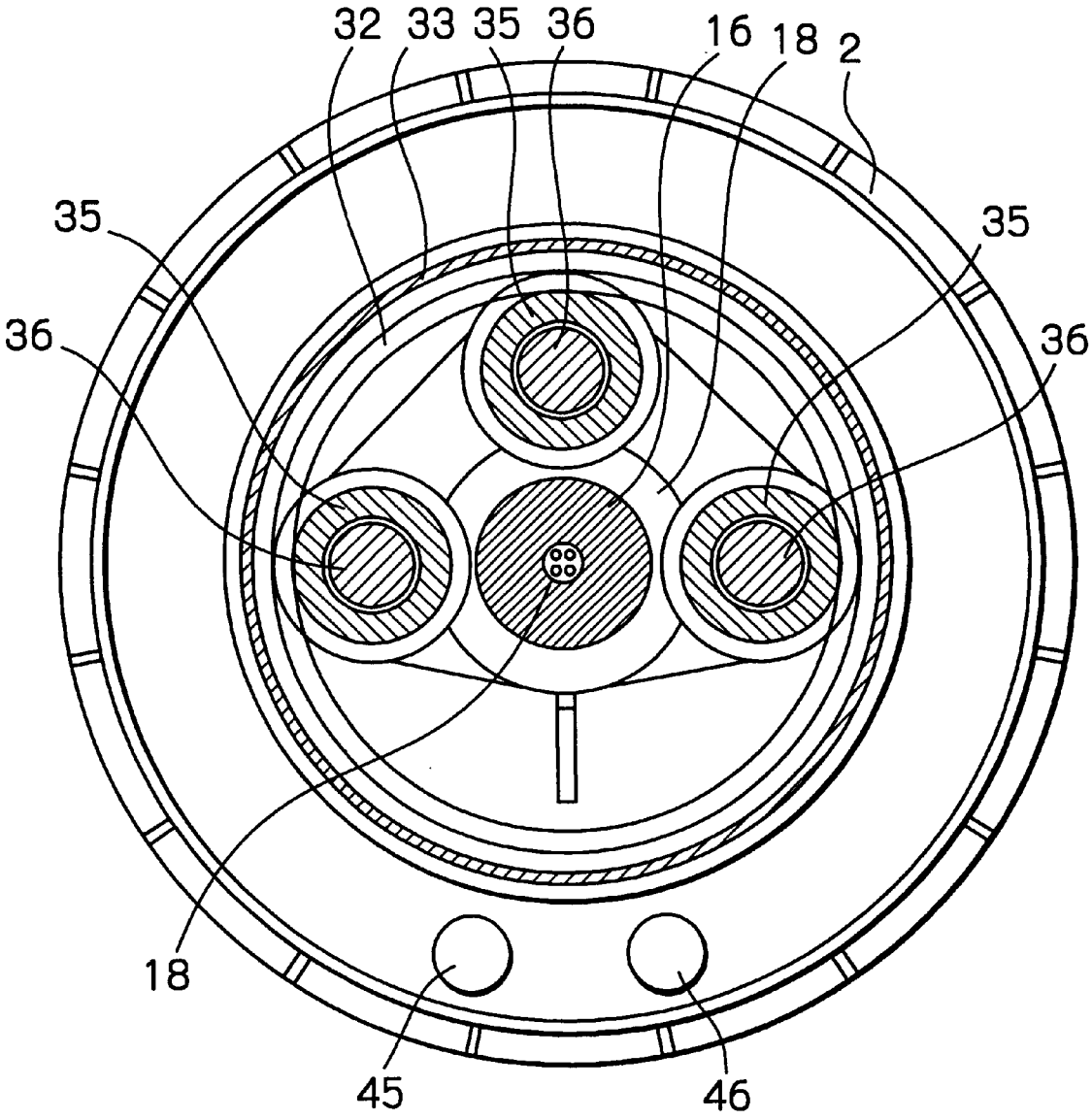
FIG. 9 is a sectional view taken along the line B—B in FIG. 3.

As shown in FIG. 8, scrapers 26A and roller bits 26B and 26C are mounted on the front of the cutter head 26. In addition, a plurality of jet spray nozzles 26F are provided on the front of the cutter head 26. The jet spray nozzles 26F are arranged in a radial direction.

The jet spray nozzles 26F communicate with water supply lines 9C of the composite piping 9 through the respective pipes 26E. Water jets sprayed from the jet spray nozzles 26F allow excavated materials to be primarily crushed into smaller pieces that can be taken into the crushing chamber 25C. It should be noted that reference numeral 26F denotes a piping cover.

An internally-toothed gear 32 is mounted on the rear end of the inner cone 25. A bearing 33 is provided on the outer peripheral portion of the internally-toothed gear 32 to bear a radial load applied to the inner cone 25. The bearing 33 is secured to a housing that forms an integral structure with the bulkheads 2A and 2B. It should be noted that reference numeral 34 denotes a packing.

Externally-toothed gears 35 are internally meshed with the internally-toothed gear 32. Each externally-toothed gear 35 is mounted on one end of a driving shaft 36 by using a gear stopper member 37. The driving shaft 36 is rotatably supported by the bearing tube 18, which is secured to the bulkheads 2A and 2B. The other end of the driving shaft 36 is connected to one of the internally-toothed gears 11. Reference numeral 39 denotes a slip ring, and reference numeral 40 denotes a slip ring retaining nut.

Figure 10:
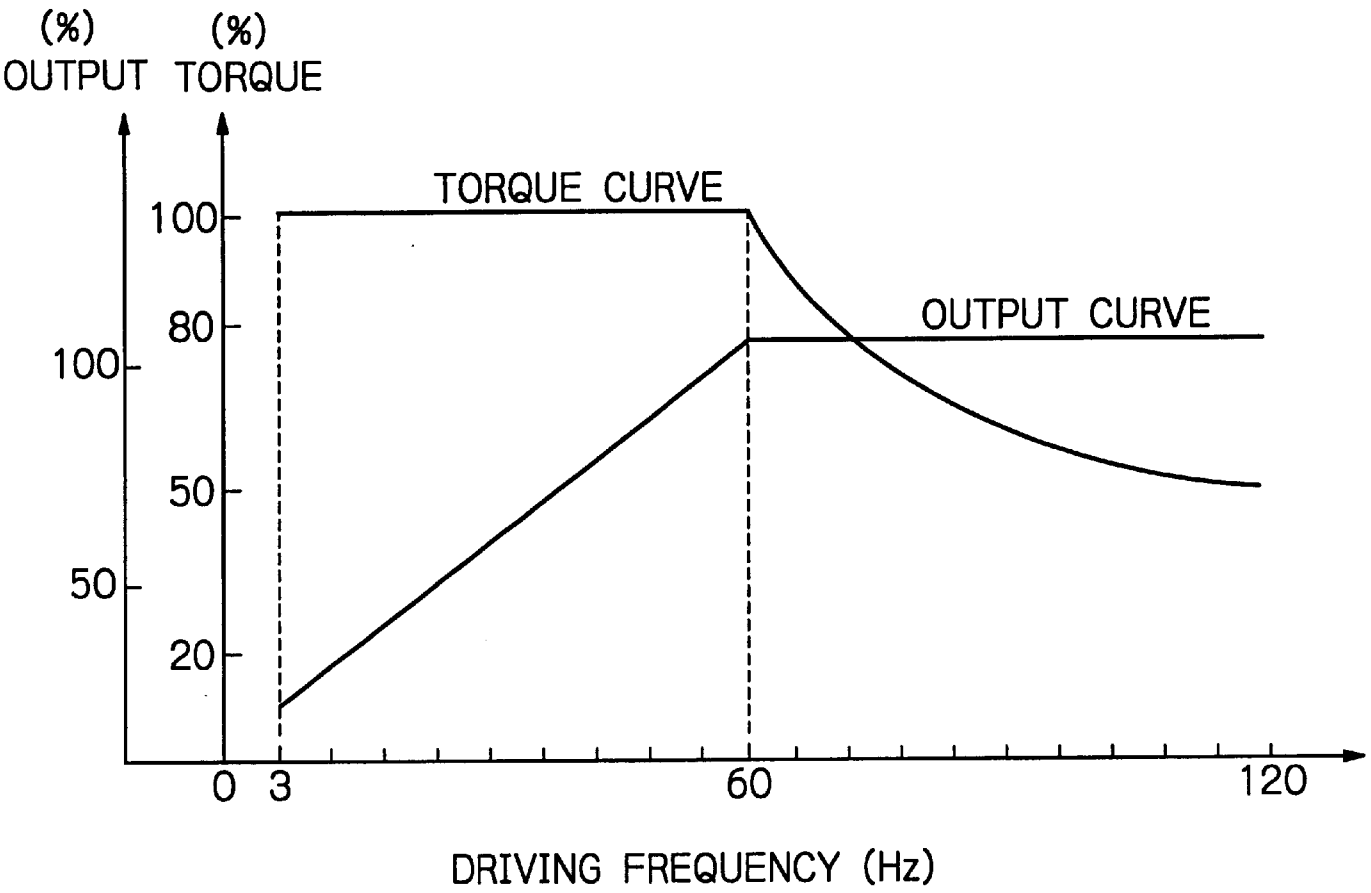
FIG. 10 is a diagram showing the output torque characteristics of a motor with reduction gears shown in FIG. 1.
Figure 11:
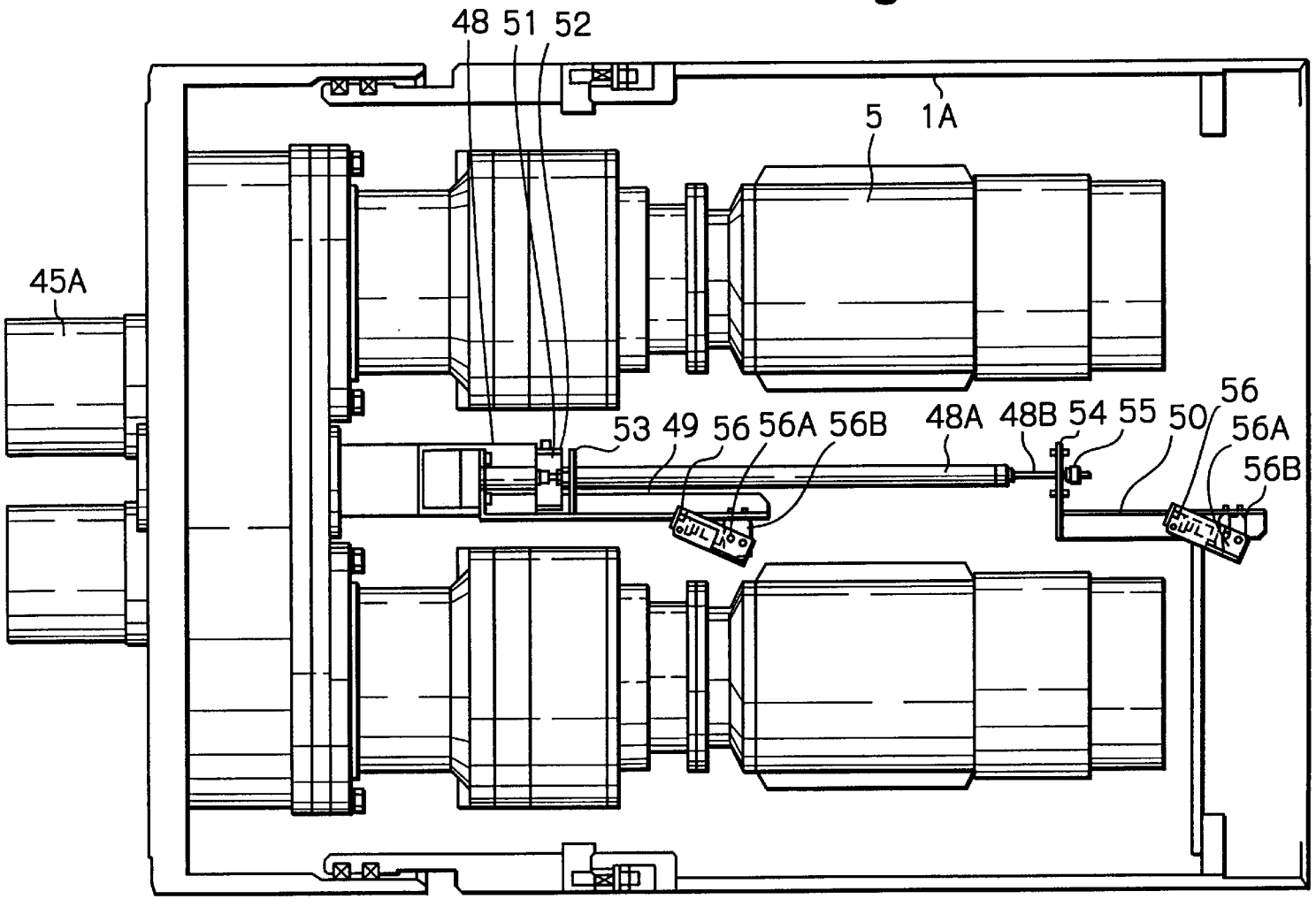
FIG. 11 is an enlarged plan view of the tail shield member shown in FIG. 2.
Figure 12:
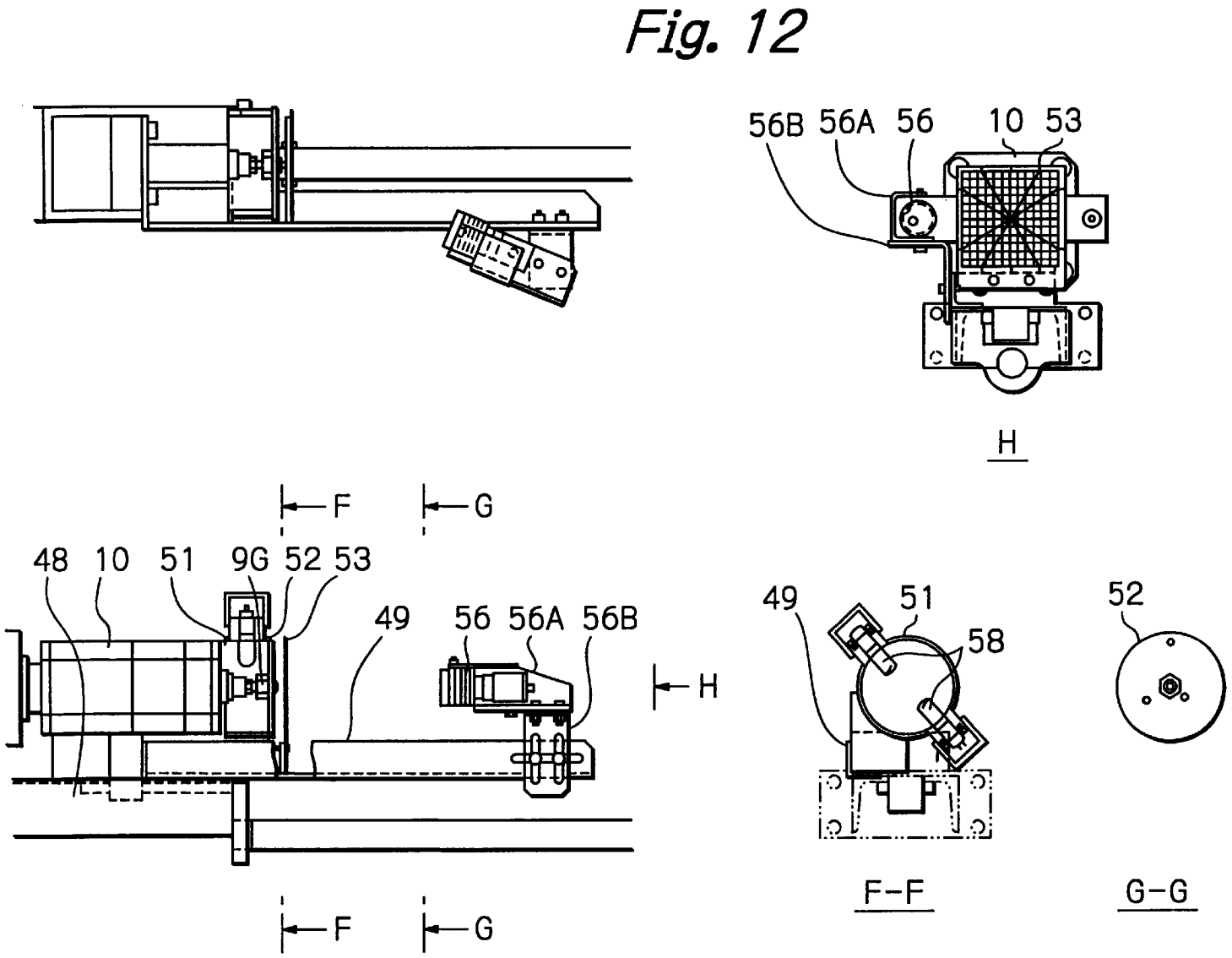
FIG. 12 is a diagram illustrating a system for detecting and displaying the positions of spray nozzles.

As each motor 5 with reduction gears, an electric motor or a hydraulic motor is used. In the former case, the motors 5 are varied in speed by inverter control. The relationship between the driving frequency on the one hand and the torque curve and the output curve on the other is, for example, as shown in FIG. 10.

A slurry feed pipe 45 and a slurry discharge pipe 46 are provided in the tail shield member 1. A seal case 45A is provided at each of the forward ends of the slurry feed pipe 45 and the slurry discharge pipe 46. The respective forward end portions of the slurry feed pipe 45 and the slurry discharge pipe 46 extend into a slurry chamber 47 at the rear of the outer cone 17. The slurry chamber 47 communicates with the crushing chamber 25C. The outer cone 17 is provided with a large number of radial grating plates 17B over a surface thereof that faces the slurry chamber 47. The grating plates 17B perform the function of preventing crushed excavated materials larger than a predetermined size from being taken into the slurry chamber 47. A partition plate 47A is provided between the slurry feed pipe 45 and the slurry discharge pipe 46.

In this excavator, as the three motors 5 with reduction gears are rotated simultaneously, for example, the three driving shafts 36 are driven to rotate through the respective output shafts 6, externally-toothed pinions 7 and internally-toothed gears 11. The internally-toothed gear 32 is driven to rotate by the three driving shafts 36. Consequently, the inner cone 25, which is integral with the internally-toothed gear 32, is rotated. In response to the rotation of the inner cone 25, the center shaft 16 is driven to rotate. Thus, the cutter head 26, which is integral with the center shaft 16, is rotated.

Excavated materials are primarily crushed by water jets into smaller pieces that can be taken into the excavator. Next, the excavated materials are secondarily crushed by the roller bits 26B and 26C of the cutter head 26. Next, the excavated materials are tertiarily crushed into smaller pieces that can be taken into the slurry discharge pipe 46 by cooperation of the inner cone 25 and the outer cone 17.

According to the embodiment of the present invention, the driving shafts 36 are provided at eccentric positions with respect to the center shaft 16, and the center shaft 16 is driven to rotate through the inner cone 25. Therefore, it is possible to reduce the cost attributable to the piping for water jets in comparison to an arrangement in which a motor 5 with reduction gears is connected directly to the center shaft 16.

That is, in a structure in which a motor 5 with reduction gears is connected directly to the center shaft 16, it is necessary to produce a motor with reduction gears in conformity to special specifications such that the output shaft 6 has a through-hole in order to provide piping for a water jet. In the embodiment of the present invention, the driving shafts 36 are provided at respective positions that are eccentric with respect to the center shaft 16, and the motors 5 with reduction gears are connected directly to the driving shafts 36. Accordingly, there is no need of a motor with reduction gears built to special specifications, and the cost reduces correspondingly.

In addition, because the inner cone 25 is eccentric relative to the internally-toothed gear 32, which is concentric with the center shaft 16, it is possible to use a straight rod-shaped shaft, not a crank-shaped shaft, as the center shaft 16. Accordingly, it becomes easy to provide the composite piping 9 for water jets in the center shaft 16.

Furthermore, because the inner cone 25 is driven through the mesh between the externally-toothed gears 35 and the internally-toothed gear 32, it is possible to provide a plurality of high-power motors 5 with reduction gears in a narrow tail shield member 1.

With the foregoing arrangement, the present invention provides advantageous effects as stated below.

The water jet spray pressure is switched between high pressure and low pressure according to the conditions of soil and obstructions in the working range, or according to circumstances, an abrasive or an additive is incorporated into spray water to cut and tear obstructions even more efficiently, thereby allowing excavation to be carried out under obstructive conditions, which has been difficult to effect with the conventional apparatus. In addition, high-power motors with reduction gears can be readily provided in a narrow shield body. Thus, it is possible to realize a multi-function excavator capable of excavation suitable for each particular ground by changing the rotational speed and torque of the driving motors in conformity to various soil conditions.

It should be noted that the present invention is not limited to the foregoing embodiment but can be modified in a variety of ways.

What is claimed is:

1. An excavator comprising:

an outer cone;

a center shaft rotatably provided in a shield body in concentric relation to said outer cone;

an inner cone eccentrically provided on said center shaft to crush excavated materials in cooperation with said outer cone;

a cutter head provided in front of said inner cone;

an internally-toothed gear secured to said inner cone, said internally-toothed gear being concentric with said center shaft;

an externally-toothed gear internally meshed with said internally-toothed gear, said externally-toothed gear being driven to rotate by a driving motor, so that rotation of said externally-toothed gear causes said center shaft to rotate through said inner cone;

a plurality of water jet spray nozzles provided on said cutter head; and a multihole compressed water pipe provided in said center shaft, said compressed water pipe communicating with said water jet spray nozzles, wherein said compressed water pipe selectively supplies low-pressure water and high-pressure water such that, during excavation of ground free from obstructions, the low-pressure water is supplied, whereas, during excavation of ground containing obstructions, the high-pressure water is supplied.

2. An excavator according to claim 1, wherein water supplied to said compressed water pipe is mixed with one of an abrasive for cutting obstructions and an additive for tearing obstructions according to soil conditions.

3. An excavator according to claim 1, wherein said driving motor is one of an electric motor and a hydraulic motor.

4. An excavator according to claim 3, wherein a rotational speed and torque of said driving motor are controlled according to soil conditions.

5. An excavator according to claim 4, wherein said driving motor is a motor with reduction gears and varied in speed by inverter control.

6. An excavator according to claim 3, wherein said driving motor is a motor with reduction gears and varied in speed by inverter control.

7. An excavator according to claim 1, wherein a rotational speed and torque of said driving motor are controlled according to soil conditions.

8. An excavator according to claim 7, wherein said driving motor is a motor with reduction gears and varied in speed by inverter control.

9. An excavator according to claim 1, wherein said driving motor is a motor with reduction gears and varied in speed by inverter control.

10. An excavator according to claim 1, wherein said center shaft is provided with a composite swivel joint for water jets.

11. An excavator according to claim 10, wherein said composite swivel joint has composite piping formed in said center shaft and connected to said water jet spray nozzles to function as a multi-passage swivel joint.

12. An excavator according to claim 11, wherein said water jet spray nozzles are provided at a forward end of said composite piping and connected to said composite piping through respective pipes, so that a water jet spray nozzle at an appropriate position can be selected to spray a water jet.

13. An excavator according to claim 11, wherein said spray nozzles are installed on said cutter head at any desired angles, so that spray directions of water jets can be set freely.

14. An excavator according to claim 12, wherein said spray nozzles are installed on said cutter head at any desired angles, so that spray directions of water jets can be set freely.

15. An excavator according to claim 14, wherein a slit plate is secured to a rear end of a shaft of said composite swivel joint, said slit plate having slits at positions corresponding to positions of said spray nozzles installed on said cutter head, thereby detecting positions of said spray nozzles.

16. An excavator according to claim 10, wherein a slit plate is secured to a rear end of a shaft of said composite swivel joint, said slit plate having slits at positions corresponding to positions of said spray nozzles installed on said cutter head, thereby detecting positions of said spray nozzles.

17. An excavator according to claim 6, wherein a lamp box is provided in front of said slit plate, and a front target is provided behind said slit plate, thereby detecting a direction of excavation.

18. An excavator according to claim 1, wherein a pinion is provided on an output shaft of said motor with reduction gears, said pinion being internally meshed with an internally-toothed gear that is rotatable relative to a bulkhead, so that rotation of said motor is secondarily reduced in speed, and wherein a driving shaft is concentrically secured to said internally-toothed gear, said externally-toothed gear being mounted on said driving shaft.

19. An excavator according to claim 1, wherein an earth pressure detector is provided at a rear end of said center shaft to detect a change in axial force acting on said cutter head, thereby detecting an earth pressure during excavation.

20. An excavator according to claim 1, wherein said shield body is provided with a gripper mechanism for preventing rolling of said shield body, said gripper body including a hydraulic cylinder mounted on an inner wall of said shield body, said gripper body further including a revolving roller, said revolving roller being capable of advancing toward a tunnel inner wall and retracting therefrom, wherein a pressure with which said revolving roller is pressed against said tunnel inner wall is adjustable with said hydraulic cylinder.

* * * * *

UNITED STATES PATENT AND TRADEMARK OFFICE

CERTIFICATE OF CORRECTION

PATENT NO. : 6,332,652 B1
DATED : December 25, 2001
INVENTOR(S) : Kenichi Nakakuro It is certified that error appears in the above-identified patent and that said Letters Patent is hereby corrected as shown below:

Title page,
Item [30], please delete the following: "Feb. 2, 1999 (JP) …… 11-25459".

Signed and Sealed this

Twenty-fourth Day of September, 2002

*Attest:*

*Attesting Officer*

JAMES E. ROGAN
*Director of the United States Patent and Trademark Office*